US006779879B2

(12) United States Patent
Zhan

(10) Patent No.: US 6,779,879 B2
(45) Date of Patent: Aug. 24, 2004

(54) ELECTRODE ARRANGEMENT FOR AN INK JET PRINTER

(75) Inventor: Xuedong Zhan, Wilmette, IL (US)

(73) Assignee: Videojet Technologies, Inc., Wood Dale, IL (US)

( * ) Notice: Subject to any disclaimer, the term of this patent is extended or adjusted under 35 U.S.C. 154(b) by 3 days.

(21) Appl. No.: 10/114,884

(22) Filed: Apr. 1, 2002

(65) Prior Publication Data

US 2003/0184621 A1 Oct. 2, 2003

(51) Int. Cl.[7] ..... B41J 2/09
(52) U.S. Cl. ..... 347/77
(58) Field of Search ..... 47/76, 77, 82, 47/73–75, 15

(56) References Cited

U.S. PATENT DOCUMENTS

| | | | | |
|---|---|---|---|---|
| 3,895,386 A | | 7/1975 | Keur et al. | 347/77 |
| 4,075,636 A | | 2/1978 | Galetto et al. | 347/53 |
| 4,122,458 A | * | 10/1978 | Paranjpe | 347/77 |
| 4,138,688 A | | 2/1979 | Heard et al. | 347/77 |
| 4,167,741 A | | 9/1979 | Heard et al. | 347/77 |
| 4,246,589 A | | 1/1981 | Denny et al. | 347/77 |
| 4,338,613 A | * | 7/1982 | Cruz-Uribe | 347/82 |
| 4,394,663 A | * | 7/1983 | Ameyama | 347/76 |
| 4,617,574 A | | 10/1986 | Millet et al. | 347/49 |
| 4,743,922 A | | 5/1988 | Regnault et al. | 347/74 |
| 4,845,512 A | * | 7/1989 | Arway | 347/77 |
| 5,434,609 A | * | 7/1995 | Rhodes | 347/77 |
| 6,505,921 B2 | * | 1/2003 | Chwalek et al. | 347/77 |

OTHER PUBLICATIONS

Pub No. 2002/118258 A1, Bajeux, Printing Head and Printer with Improved Deflection Electrodes, pub date Aug. 29, 2002, entire document.*

"Ink Jet Deflection Plate Arrangement", West et al., IBM Technical Disclosure Bulletin, pp. 476–477, vol. 15, No. 2, Jul. 1972.

* cited by examiner

*Primary Examiner*—K. Feggins
(74) *Attorney, Agent, or Firm*—McAndrews, Held & Malloy, Ltd.

(57) ABSTRACT

A deflection electrode assembly is provided for use in a continuous ink jet printer of the type which projects a stream of ink drops toward a substrate and controls placement of the ink drops on the substrate by selectively charging the individual ink drops and passing the charged ink drops through an electric field created between a pair of opposed deflection electrodes. An opening formed in at least one of the electrodes is aligned with the ink drop stream so that micro-satellite ink drops can pass through the opening. For example, when the ink drops are negatively charged, the opening may be formed in the high voltage deflection electrode. The high voltage electrode may include first and second longitudinally extending legs positioned adjacent the ink drop stream, opposite the low voltage electrode. The legs define the opening, which is aligned with the ink drop stream. The opening may have an open end facing away from the substrate and a closed end facing towards the substrate. A dielectric insulating material may be disposed on the high voltage electrode. The insulating material may be in the form of sleeves that slide onto the first and second legs. A means is provided for collecting micro-satellite ink drops that pass through the opening. The means may include absorbing material positioned above the opening. Alternatively, the means may comprise a vacuum assembly for collecting the micro-satellite ink drops. Alternatively, the means may comprise an open space above the longitudinal slot. Air may be circulated through the open space for dispersing the micro-satellite ink drops as they pass up through the opening.

24 Claims, 2 Drawing Sheets

ELECTRODE ARRANGEMENT FOR AN INK JET PRINTER

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to ink jet printing, and in particular to an improved deflection electrode assembly for use in a continuous ink jet printer.

Continuous ink jet printers are well known in the field of industrial coding and marking, and are widely used for printing information, such as expiry dates, on various types of substrate passing the printer on production lines. As shown in FIG. 1, a jet of ink is broken up into a regular stream of uniform ink drops by an oscillating piezoelectric element. The drops then pass a charging electrode where the individual drops are charged to selected voltages. Next, the drops pass through a transverse electric field (deflection field) provided between a pair of deflection electrodes. Each drop is deflected by an amount that depends on its respective charge. If the drop is uncharged, it will pass through the deflection electrodes without deflection. Uncharged and slightly charged drops are collected in a catcher and returned to the ink supply for reuse. A drop following a trajectory that misses the catcher will impinge on the substrate at a point determined by the charge on the drop. Often, each charged drop is interspersed by a guard drop with substantially no charge to decrease electrostatic and aerodynamic interaction between charged drops. As the substrate is moving past the printer, the placement of the drop on the substrate in the direction of motion of the substrate will have a component determined by the time at which the drop is released. The direction of motion of the substrate will hereinafter be referred to as the horizontal direction, and the direction perpendicular to this, in the plane of the substrate, will hereinafter be referred to as the vertical direction. These directions are unrelated to the orientation of the substrate and printer in space. If the drops are deflected vertically, the placement of a drop in the vertical and horizontal direction is determined both by the charge on the drop and the position of the substrate.

Certain inks, including pigmented inks, have a tendency to create micro-satellite drops which are typically 2 to 3 orders of magnitude smaller than the main ink drops. These micro-satellite drops, when passing through the deflection field, tend to move much faster towards the high voltage deflection electrode due to their relatively large charge-to-mass ratio. As a result, these micro-satellite drops often land on the deflection electrode, causing a rapid accumulation of ink on the deflection electrode. As ink accumulates on the deflection electrode, the strength of the deflection field is reduced, resulting in a reduction in print quality. As a result, printer operation must be interrupted to clean the ink buildup off of the deflection electrode.

BRIEF SUMMARY OF THE INVENTION

Certain aspects of a specific embodiment of the present invention relate to a deflection electrode assembly for use in a continuous ink jet printer of the type which projects a stream of ink drops toward a substrate and controls placement of the ink drops on the substrate by selectively charging the individual ink drops and passing the charged ink drops through an electric field created between a pair of opposed deflection electrodes. At least one of the deflection electrodes includes an opening aligned with the ink drop stream so that micro-satellite ink drops can pass through the opening. For example, when negatively charged drops are passed between opposed high and low voltage deflection electrodes, the opening may be provided in the high voltage deflection electrode. In this respect, the high voltage deflection electrode may include first and second longitudinally extending legs positioned adjacent the ink drop stream, opposite the low voltage electrode. The legs define the opening, which is aligned with the ink drop stream. The opening has an open end facing away from the substrate and a closed end facing towards the substrate. The opening may be in the form of a generally rectangular slot which extends longitudinally along the ink drop stream.

A dielectric insulating material may be disposed on the high voltage electrode. The insulating material may include sleeves that slide onto the first and second legs.

The invention may include means for collecting micro-satellite ink drops that pass through the longitudinal opening. The means may comprise absorbing material positioned above the longitudinal opening. Alternatively, the means may comprise a vacuum assembly for collecting the micro-satellite ink drops. Alternatively, the means may comprise an open space above the longitudinal opening. Means, such as a fan or source of pressurized air, may be provided for circulating air through the open space to disperse the micro-satellite ink drops as they pass up through the longitudinal opening.

Another aspect of an embodiment of the present invention relates to a method for reducing ink accumulation on the deflection electrodes in a continuous ink jet printer. The ink jet printer is of the type which projects a stream of ink drops toward a substrate and controls placement of the ink drops on the substrate by selectively charging the individual ink drops and passing the charged ink drops through an electric field created between opposed deflection electrodes. The method includes providing an opening in at least one of the deflection electrodes and aligning the opening with the drop stream so that micro-satellite ink drops can pass through the opening. For example, when negatively charged drops are passed between opposed high and low voltage deflection electrodes, the opening may be provided in the high voltage deflection electrode. The opening may be a generally rectangular slot, which extends longitudinally along the ink drop stream.

The method may also include disposing insulating material on a high voltage electrode to reduce arcing between the high and low voltage electrodes. The method may further include collecting the micro-satellite ink drops that pass through the longitudinal opening. The drops may, for example, be collected by an absorbing material positioned adjacent the longitudinal opening. Alternatively, the micro-satellite ink drops may be vacuumed up as they pass through the opening. Alternatively, air can be circulated through the open space above the opening to disperse the micro-satellite drops as they enter the open space.

The foregoing summary, as well as the following detailed description of the preferred embodiments of the present invention, will be better understood when read in conjunction with the appended drawings. For the purpose of illustrating the preferred embodiments of the present invention, the drawings depict embodiments that are presently preferred. It should be understood, however, that the present invention is not limited to the arrangements and instrumentality shown in the attached drawings.

DETAILED DESCRIPTION OF THE INVENTION

Figure 1:
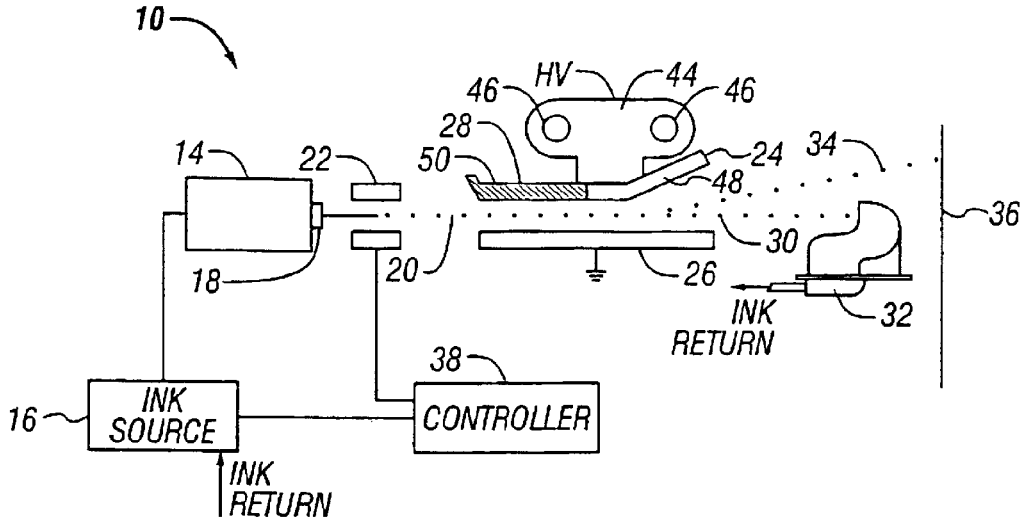
FIG. 1 illustrates a continuous ink jet printer incorporating an electrode arrangement according to certain aspects of an embodiment of the present invention.

FIG. 1 illustrates a continuous ink jet printer 10 according to certain aspects of an embodiment of the present invention. The ink jet printer 10 includes a print head with a drop generator 14, which receives ink from an ink source 16. The drop generator 14 incorporates a piezoelectric oscillator which creates perturbations in the ink flow at a nozzle 18. A stream 20 of regular sized and spaced drops is accordingly emitted from the nozzle 18. The drops pass through a charging tunnel 22, where a different charge can be applied to each drop. The drops then pass between a pair of deflection electrodes, namely a high voltage deflection electrode 24 and a low voltage deflection electrode 26. In most applications the low voltage electrode is grounded. In the illustrated embodiment, the drops are negatively charged such that they are attracted/deflected towards the positively charged high voltage deflection electrode 24 as they pass between the deflection electrodes 24, 26. The charge applied to a drop determines its degree of deflection as the drop passes between the deflection electrodes 24, 26. Insulation 28 (shown in the dotted hatching) may be disposed on the deflection electrodes 24, 26 to prevent arcing between the deflection electrodes 24, 26, and between the high voltage electrode 24 and the charging tunnel 22. For ease of reference herein, the deflection electrodes 24, 26 may also be referred to as the high voltage deflection electrode 24 and the low voltage deflection electrode 26, or simply as the high voltage electrode 24 and the low voltage electrode 26. The present example illustrates negatively charged ink drops and a high voltage deflection electrode 24 with a positive charge. However, it will be appreciated that other configurations can be employed without departing from the scope of the present invention. For example, negatively charged drops can be passed between a negatively charged high voltage electrode and a low voltage ground electrode. In such a configuration, the drops are repelled away from the high voltage electrode and towards the low voltage electrode.

Uncharged or slightly charged drops 30 pass substantially undeflected to a catcher 32, and are recycled to ink source 16. Charged drops 34 are projected toward a substrate 36 and are deflected so as to have a trajectory striking the substrate 36 as the substrate 36 moves past the print head in the horizontal direction. The level of charge applied to a given drop controls its vertical displacement/position on the substrate 36.

The charge to be applied to a drop is determined by a controller 38, which may be implemented by a device such as a general purpose processor, microcontroller, or embedded controller having appropriate input and output circuitry, as is well known in the art. The controller 38 operates under general program control of the instructions stored in an associated memory. The controller 38 is programmed to deliver control signals to the charge tunnel 22 to control the charges applied to the individual drops as they pass through the charge tunnel 22. Operation of such ink jet printers is well known in the art and, hence, will not be explained in greater detail herein.

The low voltage deflection electrode 26 includes a generally planar deflection plate 40, which is positioned below the stream of ink drops. The low voltage electrode 26 may include a mounting portion, not shown, for securing the electrode 26 to the frame (not shown) of the printer 10 or to some other mounting structure.

The high voltage deflection electrode 24 includes a deflection plate 42 and a mounting bracket 44. The mounting bracket 44 presents mounting apertures 46 that allow the high voltage electrode 24 to be secured to the frame of the printer 10 or other mounting structure by fasteners (not shown).

The deflection plate 42 of the high voltage electrode 24 extends along the ink drop stream 20 at a location opposite the deflection plate 40 of the low voltage electrode 26. The deflection plate 42 includes a front portion 50 and a rear portion 48. As can be seen in FIG. 1, the front portion 50 extends generally parallel to the deflection plate 40 of the low voltage electrode 26, whereas the rear portion 48 angles upwardly as shown to generally conform the high voltage deflection electrode 24 to the path of the charged drops.

Figure 2:
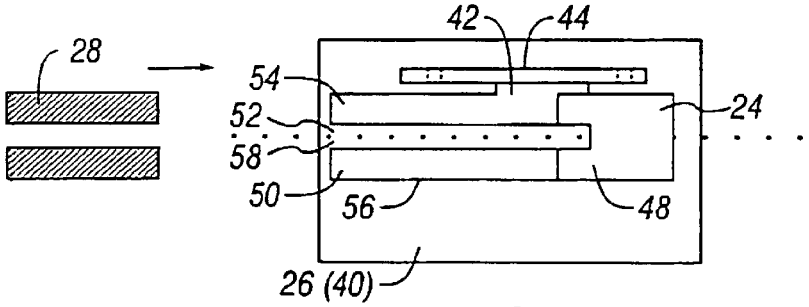
FIG. 2 is a top view of the electrode arrangement as shown in FIG. 1.

As can be seen in FIG. 2, the deflection plate 42 includes a longitudinal opening 52, which is positioned to align with the drop stream 20. In the illustrated embodiment, the opening is in the form of a generally rectangular slot which divides the deflection plate 42 into first and second laterally spaced legs 54, 56. The opening 52 may be on the order of 0.0500 inches to 0.0625 inches wide. The longitudinal opening 52 has a front opening 58, which faces the charging tunnel 22. The rear of the longitudinal opening 52 is closed by the rear portion 48 of the plate 42. The opening 52 may extend partially into the rear portion 48 of the plate 42, as is shown in the drawings.

The opening 52 is positioned such that the micro-satellite drops pass through the opening 52 where they can be captured or otherwise disposed of. Because the micro-satellite drops do not build up on the high voltage electrode 24, as can occur with prior electrode designs, print quality can be maintained for an increased duration between servicing of the printer.

While the illustrated example shows the opening 52 formed in the high voltage deflection electrode 24, it will be appreciated that in some applications it may be desirable to alternatively or additionally provide such an opening in the low voltage deflection electrode. For example, when positively charged ink drops are passed between a highly charged positive electrode and a low voltage electrode, the drops will be repelled (pushed) away from the high voltage electrode. In such a configuration, a longitudinal opening is provided in the low voltage deflection electrode to allow micro-satellite ink drops to pass through the opening low voltage electrode where they can be collected or otherwise disposed of. Similarly, when negatively charged drops are passed between a low voltage deflection electrode and negatively charged a high voltage deflection electrode, a longitudinal opening can be provided in the low voltage deflection electrode.

Figure 3:
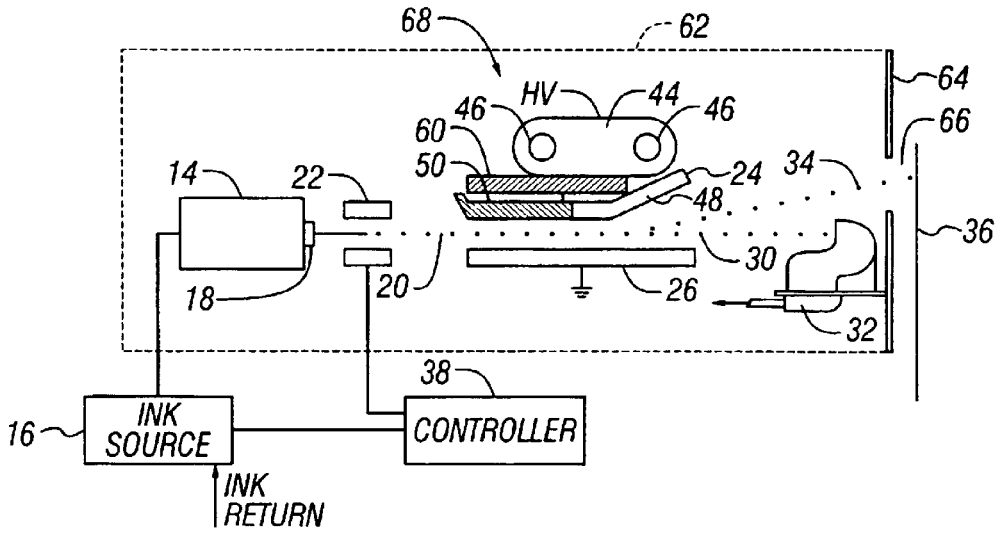
FIG. 3 illustrates absorbing material that can be used in connection with the electrode arrangement of FIG. 1.

As is shown in FIG. 3, absorbing material 60, such as cellular polyurethane, can be positioned above the slot 52 to capture the micro-satellite drops. In this respect, the print head 12 is contained within a housing 62 (depicted using broken lines in FIGS. 3 and 4), which may, for example, be tubular in shape. The distal end of the housing 62 is closed by an end plate 64. The end plate 64 presents a slot or aperture 66. The charged drops 34 are projected through the aperture 66 and onto the substrate 36. The housing defines an open space 68 around the print head components. The absorbing material 60 is positioned in the open space 68, above the electrode 24. The housing 62 may be removed so that the absorbing material 60 can be cleaned or replaced as needed.

Figure 4:
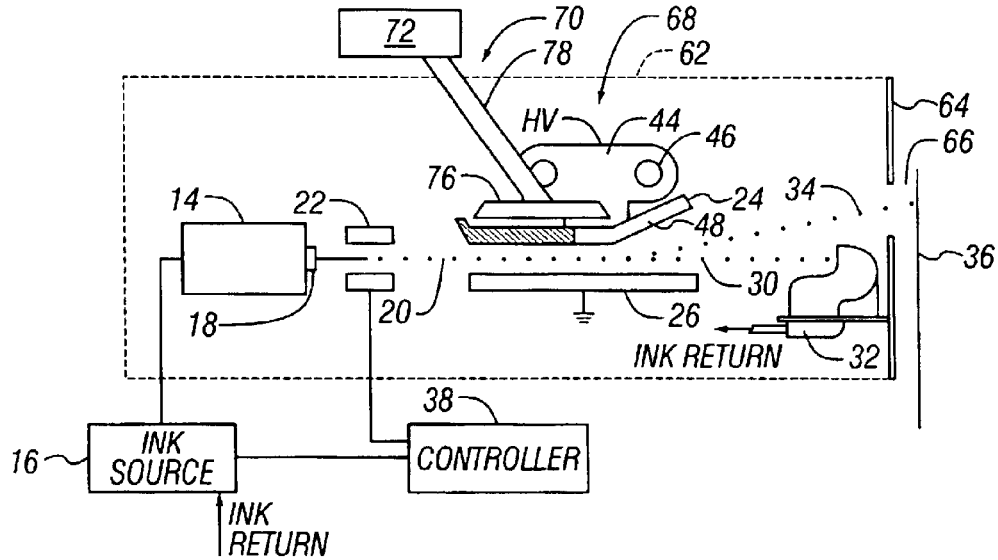
FIG. 4 illustrates a vacuum assembly that can be used in connection with the electrode arrangement of FIG. 1.

Alternatively, as is depicted in FIG. 4, a vacuum assembly 70 can be provided for collecting the micro-satellite ink drops as they pass up through the longitudinal slot 52. The vacuum assembly 70 operates in much the same manner as a typical household vacuum and it includes a vacuum housing 72, a waste container (not shown) in which the ink is accumulated, a collection nozzle 76 positioned above the longitudinal slot 52, and a hose 78 extending between the nozzle 76 and the ultimately the waste container. The waste container can be located in the vacuum housing 72, or it can be positioned remotely from the vacuum housing 72. Alternatively, the ink collected by the vacuum assembly 70 could be recycled to the ink source 16 for reuse by the printer 10, in which case a waste container would not be required.

In yet another alternative, the micro-satellite ink drops can be allowed to pass directly into the open space 68 above the high voltage electrode 24 in the print head. In such a design, means may be provided for circulating air through the housing 62 from its front end towards its rear end. The means may, for example, be in the form of a fan or a source of pressurized air. The pressurized air can, for example, be supplied from the printer's manifold (not shown), as is commonly done to maintain a positive pressure in the print head so as to prevent dirt and other contaminates from entering the print head. The flow of air through the housing 62 disperses the micro-satellite drops as they pass up through the longitudinal opening 52 and into the open space 68 of the housing 62. The means may continuously circulate air through the housing. Alternatively, the means may operate to circulate air through the housing 62 only when drops are being charged for printing on the substrate 36.

As was mentioned above, insulation 28 may be positioned on the high voltage electrode 24 to reduce arcing between the high and low voltage deflection electrodes 24, 26, and also between the high voltage deflection electrode 24 and the charging tunnel 22. The insulation 28 may be in the form of dielectric sleeves that slide over the laterally spaced legs 54, 56 of the high voltage deflection electrode 24. Alternatively, the insulation 28 may, for example, be sprayed, molded or otherwise affixed to the high voltage deflection electrode 24.

Because the opening 52 is symmetrical, the electrical field produced between the deflection electrodes 24, 26 is primarily perpendicular to the ground electrode 26 along the centerline of the electrodes, i.e., along the drop stream 20. This is particularly true near the low voltage deflection electrode 26. Computer simulations comparing the field produced with the slot versus with no slot showed that for a slot width of 0.0500 inches the electrical field had nearly a pure vertical component and that the field strength was reduced by less than 1% along the centerline.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A deflection electrode assembly for use in a continuous ink jet printer of the type which projects a stream of ink drops toward a substrate and controls placement of the ink drops on the substrate by selectively charging the individual ink drops and passing the charged ink drops through an electric field created by the deflection electrode assembly, the deflection electrode assembly comprising:

a pair of opposed deflection electrodes positioned along the ink drop stream at least one of the deflection electrodes including an opening aligned with the ink drop stream so that micro-satellite ink drops can pass through the opening.

2. A deflection electrode assembly as set forth in claim 1, wherein the pair of opposed deflection electrodes comprise a high voltage deflection electrode and a low voltage deflection electrode.

3. A deflection electrode assembly as set forth in claim 2, wherein the high voltage deflection electrode includes a longitudinal opening aligned with the ink drop stream.

4. A deflection electrode assembly as set forth in claim 2, further comprising a dielectric insulating material disposed on the high voltage electrode.

5. A deflection electrode assembly as set forth in claim 4, wherein the insulating material comprises sleeves that slide onto the high voltage electrode.

6. A deflection electrode assembly as set forth in claim 2, wherein the high voltage electrode includes a front portion and a rear portion, the front portion being generally parallel to the low voltage electrode and the rear portion angling away from the low voltage electrode to generally conform the high voltage electrode to the path of the charged drops.

7. A deflection electrode assembly as set forth in claim 1, wherein the opening comprises a generally rectangular slot.

8. A deflection electrode assembly as set forth in claim 1, further comprising means for collecting micro-satellite ink drops that pass through the opening.

9. A deflection electrode assembly as set forth in claim 8, wherein the means comprises absorbing material positioned adjacent the opening.

10. A deflection electrode assembly as set forth in claim 8, wherein the means comprises a vacuum assembly for collecting the micro-satellite ink drops.

11. A deflection electrode assembly as set forth in claim 1, wherein the ink jet printer comprises a print head within a housing, and the deflection electrode assembly further comprises means for blowing air through the housing.

12. A high voltage electrode for use in a continuous ink jet printer of the type which projects a stream of ink drops toward a substrate and controls placement of the ink drops on the substrate by selectively charging the individual ink drops and passing the charged ink drops through an electric field created between the high voltage electrode and a low voltage electrode, the high voltage electrode comprising:

first and second longitudinally extending legs positioned adjacent the ink drop stream opposite the low voltage electrode, the legs defining a longitudinal opening which is aligned with the ink drop stream.

13. A high voltage electrode as set forth in claim 12, wherein the longitudinal opening comprises a generally rectangular slot.

14. The high voltage electrode of claim 12, wherein the longitudinal opening has an open end facing away from the substrate and a closed end facing the substrate.

15. The high voltage electrode of claim 12, further comprising a dielectric insulating material disposed on the high voltage electrode.

16. The high voltage electrode of claim 15, wherein the insulating material comprises sleeves that slide onto the first and second legs.

17. The high voltage electrode of claim 12, wherein the high voltage electrode includes a front portion and a rear portion, the front portion being generally parallel to the low voltage electrode and the rear portion angling away from the low voltage electrode to generally conform the high voltage electrode to the path of the charged drops.

18. A method for reducing ink accumulation on a deflection electrode in a continuous ink jet printer of the type which projects a stream of ink drops toward a substrate and controls placement of the ink drops on the substrate by selectively charging the individual ink drops and passing the charged ink drops through an electric field created between a pair of opposed deflection electrodes, the method comprising:

providing a longitudinal opening in at least one of the deflection electrodes;

aligning the longitudinal opening with the drop stream so that micro-satellite ink drops can pass through the opening.

19. The method of claim 18, wherein the deflection electrodes comprise a high voltage deflection electrode and a low voltage electrode, and wherein the longitudinal opening is provided in the high voltage deflection electrode.

20. The method of claim 19, further comprising disposing insulating material on the high voltage electrode.

21. The method of claim 18, further comprising collecting micro-satellite ink drops that pass through the longitudinal opening in the deflection electrode.

22. The method of claim 21, further comprising providing an absorbing material adjacent the longitudinal opening.

23. The method of claim 21, further comprising vacuuming the micro-satellite ink drops that pass through the longitudinal opening.

24. The method of claim 18, wherein the ink jet printer comprises a print head with a housing, and the method further comprises blowing air through the housing.

* * * * *